US011643797B2

(12) United States Patent
Groß et al.

(10) Patent No.: US 11,643,797 B2
(45) Date of Patent: May 9, 2023

(54) WALL INSTALLATION CONNECTION BOX UNIT

(71) Applicant: Hansgrohe SE, Schiltach (DE)

(72) Inventors: Jürgen Groß, Mühlenbach (DE); Joachim Blattner, Haslach (DE); Günther Lehmann, Oberwolfach (DE); Jürgen Schorer, Schiltach (DE)

(73) Assignee: Hansgrohe SE, Schiltach (DE)

( * ) Notice: Subject to any disclaimer, the term of this patent is extended or adjusted under 35 U.S.C. 154(b) by 0 days.

(21) Appl. No.: 17/208,450

(22) Filed: Mar. 22, 2021

(65) Prior Publication Data

US 2021/0301508 A1 Sep. 30, 2021

(30) Foreign Application Priority Data

Mar. 24, 2020 (DE) ..... 10 2020 203 792.2

(51) Int. Cl.
*E03C 1/02* (2006.01)

(52) U.S. Cl.
CPC ..... *E03C 1/021* (2013.01)

(58) Field of Classification Search
CPC ..... E03C 1/021; Y10T 137/698
See application file for complete search history.

(56) References Cited

U.S. PATENT DOCUMENTS 1,822,056 A 9/1931 Noble
2,297,862 A 10/1942 Bachmann
4,181,329 A 1/1980 Helm
4,265,265 A 5/1981 Wallace
4,265,365 A 5/1981 Boteler
(Continued)

FOREIGN PATENT DOCUMENTS

AT 507052 A1 1/2010
AT 517356 1/2017
(Continued)

OTHER PUBLICATIONS

Office Action in German Language issued by the German Patent Office, Munich, Germany, dated Feb. 16, 2021, for German Patent Application No. 10 2020 203 792.2., 7 pages.
(Continued)

*Primary Examiner* — Reinaldo Sanchez-Medina
(74) *Attorney, Agent, or Firm* — Bose McKinney & Evans LLP

(57) ABSTRACT

A wall installation connection box unit, including a box housing body having a rear-side base portion and a sleeve portion projecting forward from the base portion, and a connector body disposed on the base portion. The sleeve portion peripherally surrounds an installation component mounting space, which space is accessible via an open front end face of the sleeve portion. The connector body includes an installation component connection contour facing the installation component mounting space and a conduit connection interface structure accessible on an outer side of the box housing body. Illustratively, the sleeve portion and the base portion of the box housing body are integrally formed from a synthetic foamed material, and the connector body is embedded in the synthetic foamed material of the base portion, wherein the conduit connection interface structure and the installation component connection contour are exposed.

11 Claims, 2 Drawing Sheets

(56) References Cited

U.S. PATENT DOCUMENTS

| | | | | |
|---|---|---|---|---|
| 5,046,521 | A * | 9/1991 | Jensen | E03C 1/042 137/360 |
| 5,368,065 | A * | 11/1994 | Humpert | E03C 1/021 137/360 |
| 5,783,774 | A | 7/1998 | Bowman et al. | |
| 5,913,439 | A | 6/1999 | Von Arx | |
| 5,934,032 | A | 8/1999 | Oberdorfer | |
| 6,499,771 | B1 | 12/2002 | Snyder, Sr. | |
| 6,547,285 | B1 | 4/2003 | Schoenweger et al. | |
| 6,992,252 | B1 | 1/2006 | Rao | |
| 7,523,837 | B2 | 4/2009 | Schoenweger | |
| 8,158,884 | B2 | 4/2012 | De la Borbolla | |
| 8,398,122 | B2 | 3/2013 | Crompton | |
| 8,899,431 | B1 | 12/2014 | Shotey et al. | |
| 9,086,179 | B1 | 7/2015 | Komolrochanapom | |
| 10,280,598 | B2 | 5/2019 | Tzeng | |
| 10,745,894 | B2 | 8/2020 | Colombo | |
| 10,889,968 | B2 | 1/2021 | Philipps et al. | |
| 2004/0050423 | A1 | 3/2004 | Schoenweger | |
| 2005/0194785 | A1 | 9/2005 | Shemtov | |
| 2011/0101673 | A1 | 5/2011 | Kern-Emmerich et al. | |
| 2011/0309611 | A1 | 12/2011 | Smith | |
| 2012/0284994 | A1 | 11/2012 | Crompton | |
| 2013/0334220 | A1 | 12/2013 | Sohler | |
| 2015/0259891 | A1 | 9/2015 | Iamert et al. | |
| 2016/0352087 | A1 | 12/2016 | Wurms | |
| 2017/0002551 | A1* | 1/2017 | Zhou | E03C 1/04 |
| 2017/0152979 | A1 | 6/2017 | Klein et al. | |
| 2017/0152980 | A1 | 6/2017 | Klein et al. | |
| 2017/0256930 | A1 | 9/2017 | Wurms | |
| 2018/0003329 | A1 | 1/2018 | Sochtig et al. | |
| 2018/0017197 | A1 | 1/2018 | Meister et al. | |
| 2018/0073223 | A1* | 3/2018 | Colombo | E03C 1/23 |
| 2018/0123332 | A1 | 5/2018 | Laukhuf | |
| 2018/0266606 | A1 | 9/2018 | Meister et al. | |
| 2018/0274705 | A1 | 9/2018 | Buerli et al. | |
| 2019/0107234 | A1 | 4/2019 | Corbett et al. | |
| 2019/0134524 | A1 | 5/2019 | De Wilde | |
| 2019/0219170 | A1 | 7/2019 | Gandolfo et al. | |
| 2019/0338498 | A1* | 11/2019 | Luig | E03C 1/021 |
| 2019/0338499 | A1* | 11/2019 | Philipps | E03C 1/021 |
| 2021/0301507 | A1 | 9/2021 | Lehmann et al. | |
| 2021/0305793 | A1 | 9/2021 | Lehmann et al. | |
| 2021/0305796 | A1 | 9/2021 | Blattner et al. | |

FOREIGN PATENT DOCUMENTS

| | | | |
|---|---|---|---|
| CH | 6811237 | A5 | 2/1993 |
| CN | 204732809 | | 10/2010 |
| CN | 102057205 | A | 5/2011 |
| CN | 106195376 | A | 12/2016 |
| CN | 107620846 | A | 1/2018 |
| CN | 108290079 | A | 7/2018 |
| CN | 108626505 | A | 10/2018 |
| CN | 109630785 | A | 4/2019 |
| CN | 209388954 | U | 9/2019 |
| CN | 110557957 | A | 12/2019 |
| CN | 1064661141 | A | 3/2021 |
| CN | 114498493 | A | 5/2022 |
| DE | 2637719 | A1 | 2/1978 |
| DE | 3310138 | A1 | 10/1984 |
| DE | 3907588 | A1 | 9/1990 |
| DE | 4417485 | C2 | 8/1997 |
| DE | 19715651 | A1 | 10/1998 |
| DE | 19856156 | A1 | 6/2000 |
| DE | 20105345 | U1 | 7/2001 |
| DE | 10036996 | A1 | 1/2002 |
| DE | 10122022 | A1 | 11/2002 |
| DE | 10233858 | A1 | 1/2004 |
| DE | 102004060744 | A1 | 6/2006 |
| DE | 20321431 | | 4/2007 |
| DE | 102007002235 | | 7/2008 |
| DE | 102007044284 | | 3/2009 |
| DE | 102008064253 | | 2/2010 |
| DE | 202009014967 | U1 | 2/2010 |
| DE | 102009012838 | | 8/2010 |
| DE | 102009049711 | | 4/2011 |
| DE | 102021203393 | | 9/2013 |
| DE | 202014106179 | U1 | 3/2015 |
| DE | 102015112420 | | 2/2017 |
| DE | 102014208291 | | 2/2018 |
| DE | 102017100707 | A1 | 7/2018 |
| DE | 102017100710 | A1 | 7/2018 |
| DE | 102017127151 | | 5/2019 |
| EP | 0424690 | A1 | 5/1991 |
| EP | 1006244 | A2 | 6/2000 |
| EP | 1256662 | A2 | 11/2002 |
| EP | 1355399 | A1 | 10/2003 |
| EP | 1382757 | A1 | 1/2004 |
| EP | 1382757 | B1 | 8/2007 |
| EP | 2101002 | A2 | 9/2009 |
| EP | 2636803 | A2 | 9/2013 |
| EP | 2468966 | | 10/2013 |
| EP | 2822121 | | 1/2015 |
| EP | 2636803 | B1 | 10/2017 |
| EP | 3486380 | | 5/2019 |
| EP | 3570396 | | 11/2019 |
| GB | 622374 | A | 5/1949 |
| GB | 2337287 | A | 11/1999 |
| JP | 2002374613 | A | 12/2002 |
| NO | 336337 | | 8/2015 |
| PL | 183459 | B1 | 5/1998 |
| RU | 2518469 | C2 | 6/2014 |
| WO | 03081054 | A1 | 10/2003 |
| WO | 2010069606 | | 6/2010 |
| WO | WO2015166084 | | 11/2015 |
| WO | 2016147042 | | 9/2016 |
| WO | 2017091839 | | 6/2017 |

OTHER PUBLICATIONS

European Search Report (in German language) issued by the European Patent Office, dated Aug. 4, 2021, for European Patent Application No. 21163950.5, 8 pages.

Decision on Granting issued by the Patent Office in the Russian Federation dated Nov. 24, 2021 (including English language translation), 19 pages.

Office Action issued by the National Intellectual Property Administration, P.R. China, dated Jul. 25, 2022 for Chinese Patent Application No. 202110312440.0 (Chinese Language), 8 pages.

Office Action issued by the National Intellectual Property Administration, P.R. China, dated Jul. 25, 2022 for Chinese Patent Application No. 202110312452.3 (Chinese and English Language), 6 pages and 5 pages, respectively.

Office Action issued by the National Intellectual Property Administration, P.R. China, dated Aug. 8, 2022 for Chinese Patent Application No. 202110312348.4 (Chinese and English Lanuage), 14 pages.

* cited by examiner

WALL INSTALLATION CONNECTION BOX UNIT

CROSS-REFERENCE TO RELATED APPLICATION

This application claims priority to German Patent Application No. DE 10 2020 203 792.2, filed on Mar. 24, 2020, the disclosure of which is expressly incorporated herein by reference.

BACKGROUND AND SUMMARY OF THE DISCLOSURE

The invention relates to a wall installation connection box unit including a box housing body having a rear-side base portion and a sleeve portion projecting forward from the base portion, and a connector body disposed on the base portion of the box housing body. The sleeve portion peripherally surrounds an installation component mounting space, which space is accessible via an open front end face of the sleeve portion. The base portion here in this case means, in a context to be understood broadly, that part of the box housing body on which the connector body is held. The connector body includes an installation component connection contour on an inner side facing the installation component mounting space, and a conduit connection interface structure accessible on an outer side of the box housing body.

Connection box units of this type are used, for example, in sanitary installation technology for connecting installation components in the form of sanitary components, such as water outlet fittings for washbasins, bathtubs, showers or kitchen sinks or sanitary thermostat, mixer and/or shut-off valve units mounted upstream, to water conduit connections pre-installed in the building, and, in electrical installation technology, for connecting electrical installation components, such as sockets, junction boxes, sensors, actuators, light switches, etc., to electrical conduit connections pre-installed in the building. Typical in this context are especially flush-mounted designs in which the wall installation connection box unit is installed in the relevant building wall in such a manner that it ends on the front side in as flush a manner as possible with the finished building wall surface, for example a plastered wall surface or a tiled wall surface. It is understood that the building wall in this case can be either a vertical building wall in the narrower sense or a bottom wall or bottom surface or a top wall or top surface of a building or of a room, for example of a shower room, a bathroom, a toilet room, a kitchen, etc., in the sanitary case.

The conduit connection interface structure typically includes one or more connection interfaces: in the sanitary case, a fluid conduit connection interface structure in particular in the form of corresponding pipe conduit connection ports for coupling to a corresponding pipe conduit connection port in the building, for example for cold water, hot water or mixed water mixed from cold water and hot water; in the electrical case, an electrical conduit connection interface structure, in particular in the form of cable conduit connections.

The installation component connection contour of the connector body, in the sanitary case, a sanitary component connection contour and, in the electrical case, an electrical component connection contour, is designed to interact with a corresponding connection contour of an installation component to be coupled, such as a mixing unit and/or shut-off valve unit or a water outlet fitting in the sanitary case, or an electrical installation component in the electrical case. In the sanitary case, the connector body includes a fluid channel structure for fluidly connecting the fluid conduit connection interface structure on the outer side of the box to the sanitary component connection contour on the inner side of the box, and, in the electrical case, includes an electrically conductive connection of the electrical conduit connection interface structure on the outer side of the box to the electrical component connection contour on the inner side of the box.

The connection box unit is inserted with its rear side or a rear-side bottom in front into a building wall opening or placed on a building wall, for example on a wall produced in a dry construction, wherein the required conduit connections between the connections in the building and the connection interface structure of the connector body are made. After completion of the wall, the installation component can then be introduced into the mounting space of the box housing body via the open front end face of the box housing body and coupled to the matching connection contour of the connector body.

A requirement especially also of such sanitary wall installation connection box units consists in not transmitting annoying noises that can be produced by a connected sanitary fitting or can be transmitted via the water network in the building as water-borne sound or structure-borne sound, to the box housing body or at any rate not being amplified by the latter in the manner of a resonant body. Here, in conventional connection box units, the connector body is generally composed of metal, and the box housing body generally of a stiff plastics material. A further requirement generally consists in ensuring sufficient water tightness of the connection box unit so that water does not leak into the building wall.

Patent publication EP 1 006 244 B1 discloses a sanitary wall installation connection box unit of the type mentioned at the outset, in which a connection element made of sound-absorbing material is introduced between the box housing body and the connector body in such a manner that there is no direct touching contact between box housing body and connector body. Possible fitting/conduit noises passing to the connector body are then not transmitted by the latter to the box housing body, but rather are absorbed by the sound-absorbing connection element. For this purpose, the connection element is preferably composed of a rubber-elastic material. To complete this connection box unit, after the connector body is inserted into the box housing body, the connection element is joined in between, preferably from the outer side of the housing, for which purpose the connector body is moved somewhat forwards or to the side using simple auxiliary means, or is inserted into a recess provided for this purpose in the connector body and/or in the box housing body before the connector body is fitted into the box housing body.

Laid-open publication DE 10 2004 060 744 A1 discloses a sanitary wall installation connection box unit of the type mentioned at the outset, in which the box housing body is formed from a rubber-elastic material and the connector body can be fitted into the box housing body using the rubber-elastic flexibility of the latter. In particular, radially protruding connectors on the connector body can be plugged through rubber-elastically expandable side wall openings of the box housing body and sealed on the outer side by the rubber-elastically material of the opening edge abutting thereagainst. This is intended to achieve a desired tightness and sound absorption for the connection box unit.

Laid-open publication DE 10 2017 100 710 A1 discloses a sanitary wall installation connection box unit of the type mentioned at the outset, in which the box housing body is formed in two parts from a lower shell forming a bottom and an upper shell which is connectable to the lower shell. For the installation, the connector body is placed against the lower shell, and then the upper shell is placed thereon and connected thereto. An o ring or preferably a sealing compound or adhesive compound as a sealant can be introduced between the connector body on the one hand and the lower shell or the upper shell on the other hand.

Furthermore, other sanitary wall installation connection box units are known which comprise a synthetic foamed body surrounding them on all sides without an installation component mounting space remaining accessible in the interior of a box housing body, into which mounting space a corresponding installation component can be fitted for coupling to a corresponding connection contour of a connector body connected to the box housing body. Such integrally cast connection box units, from which only conduit connectors lead out or in which the synthetic foamed body has to be cut open subsequently for coupling an installation component, are disclosed, for example, in laid-open publications DE 26 37 719 A1, EP 0 424 690 A1 and DE 197 15 651 A1, and in utility model publication DE 20 2009 014 967 U1.

It is an object of the invention to provide a wall installation connection box unit of the type mentioned at the outset which in particular provides functional advantages and/or advantages in respect of the outlay on manufacturing and/or installation in comparison to the above-mentioned prior art.

The invention achieves this and other objects by providing a wall installation connection box unit including a box housing body having a rear-side base portion and a sleeve portion projecting forward from the base portion, and a connector body disposed on the base portion of the box housing body. The sleeve portion peripherally surrounds an installation component mounting space, which space is accessible via an open front end face of the sleeve portion. The connector body includes an installation component connection contour on an inner side facing the installation component mounting space, and a conduit connection interface structure accessible on an outer side of the box housing body. The sleeve portion and the base portion of the box housing body are integrally formed from a synthetic foamed material, and the connector body is embedded in the synthetic foamed material of the base portion. The conduit connection interface structure and the installation component connection contour are exposed, i.e. they are not covered by the synthetic foamed material. The connector body is illustratively composed of a stiffer or firmer metal or plastics material than the synthetic foamed material of the box housing body.

The integral production of the sleeve portion and the base portion of the box housing body from a synthetic foamed material and the embedding of the connector body in the synthetic foamed material of the base portion simplify the manufacturing and installation since it is not necessary to join together a plurality of parts of the box housing body, and the attaching of the connector body can take place together with the production of the box housing body in a joint manufacturing process, in which the box housing body is formed from the synthetic foamed material and at the same time the connector body is embedded therein, for example by casting or foam encapsulation.

The synthetic foamed material provides the box housing body with desired sound-absorbing properties, thus rendering other sound-absorbing measures superfluous. Furthermore, embedding the connector body in the adjacent synthetic foamed material makes it possible to provide a desired tightness of the connection box unit, in particular at the boundary surface between connector body and box housing body, without further sealing measures having to be taken for this purpose. The synthetic foamed material of the box housing body can also provide a desired thermal insulation.

In a development of the invention, the connector body has an annular shape and is surrounded by adjacent synthetic foamed material of the base portion on a peripheral outer side. Accordingly, a closed or open annular shape that is known per se can be used for the connector body. In this case, the installation component connection contour is illustratively formed on a peripheral inner side of the connector body, while the connector body is surrounded on the peripheral outer side in a manner protected by the synthetic foamed material of the box housing body. Alternatively, the connector body has a different conventional shape, for example a disc shape or a cylinder shape or a truncated cone shape.

In a development of the invention, the base portion has a closed rearward bottom, and the connector body on a rear side adjoins the synthetic foamed material of the bottom. This closed design of the bottom provides a tight, rearward bottom region for the connection box unit solely by means of the synthetic foamed material of the box housing body. The synthetic foamed material of the base covers the connector body on a rear side such that the connector body is not exposed to the outside on the rear side. Alternatively, the connection box unit is not closed on the rear side, and/or the connector body forms part of a rearward bottom to which the box housing body then contributes a remaining part.

In a development of the invention, the connector body on the front side on a boundary region adjoins the synthetic foamed material of the base portion. With this embodiment, the connector body is consequently embedded in the direction of the front side in the synthetic foamed material of the box housing body. This can contribute to holding the connector body reliably in the base portion of the box housing body and/or to embedding same at least substantially in adjacent synthetic foamed material of the base portion of the box housing body. Alternatively, the connector body can be kept free on the front side from adjacent synthetic foamed material of the box housing body.

In a development of the invention, the connector body has a closed annular shape, wherein the installation component connection contour is provided on an inner peripheral side of the connector body, and the at least one conduit connection interface structure is formed on an outer peripheral side of the connector body. This is a favorable embodiment of the connector body for many applications, permitting a peripheral coupling to connections in the building. If required, the bottom surface of the box housing body can therefore be kept free of such conduit connection structures. Alternatively, the conduit connection interface structure can also include one or more connections emerging axially from the connector body or connections exclusively emerging axially from the connector body.

In a development of the invention, the connector body has at least one passage opening extending from its outer side to its inner side, which opening is covered on an outer side by a sealing membrane portion of the synthetic foamed material of the base portion. This realization makes it possible, when required, to optionally pass a further elongate element, which is provided if required, for example an electrical cable, a fluid pipe or the like, through the connector body and the box housing body, for which purpose the passage opening is then exposed by perforating the sealing membrane portion of the synthetic foamed material. In alternative embodiments in which this is not required, such a passage opening covered by a sealing membrane portion of the synthetic foamed material of the box housing body is absent in the connector body.

In a refinement of the invention, the synthetic foamed material of the base portion includes a tube insertion port opening which adjoins the sealing membrane portion at an outer side. When required, a tube can thus be advantageously inserted into said tube insertion port opening and can thereby be held on the base portion of the box housing body. The tube can be, for example, a hollow tube or empty tube to the passage of an electrical cable. In alternative embodiments, no such tube insertion port opening is formed on the base portion of the box housing body.

In a development of the invention, the sleeve portion has a radially inwards projecting ridge protrusion on an inner peripheral side. When required, this can advantageously be used, for example, to guide and to hold a sleeve-shaped extension sleeve in a sealed manner in the sleeve portion in a manner such that it can be adjusted in height continuously axially, for example in order to extend the axial extent of the box housing body variably in the forwards direction by means of such an extension sleeve. Alternatively, the sleeve portion of the box housing body is formed without such a ridge protrusion.

In a development of the invention, at least one connection structure element is embedded into the synthetic foamed material of the base portion. The connection structure element has a connection structure which can interact with a connection body with which a functional surface body can be held on the base portion, the functional surface body providing a functional surface, for example surrounding the sleeve portion, radially outside the sleeve portion, which functional surface can act, for example, as a fastening surface or a sealing surface, in order to provide a fastening means and/or a sealing means for the box housing body with respect to a building wall surface. In alternative embodiments, the connection box unit does not have any such embedded connection structure element.

In a development of the invention, the synthetic foamed material is a thermoplastic particle foamed material. This is an advantageous choice for the synthetic foamed material of the box housing body for numerous applications. The thermoplastic particle foamed material, for example made of polypropylene, is favorable in respect of the outlay on manufacturing and in respect of its functional properties regarding the desired functions of sound/noise absorption, thermal insulation and sealing. It has a desired predeterminable strength or rigidity, on the one hand, and a desired predeterminable sound- and shock-absorbing flexibility, on the other hand.

Additional features and advantages of the present invention will become apparent to those skilled in the art upon consideration of the following detailed description of the illustrative embodiments best exemplifying the best mode of carrying out the invention as presently perceived.

BRIEF DESCRIPTION OF THE DRAWINGS

Advantageous exemplary embodiments of the invention are illustrated in the drawings. These and further illustrative embodiments of the invention will be described in more detail below. In the drawings.

DETAILED DESCRIPTION OF THE DRAWINGS

Figure 1:
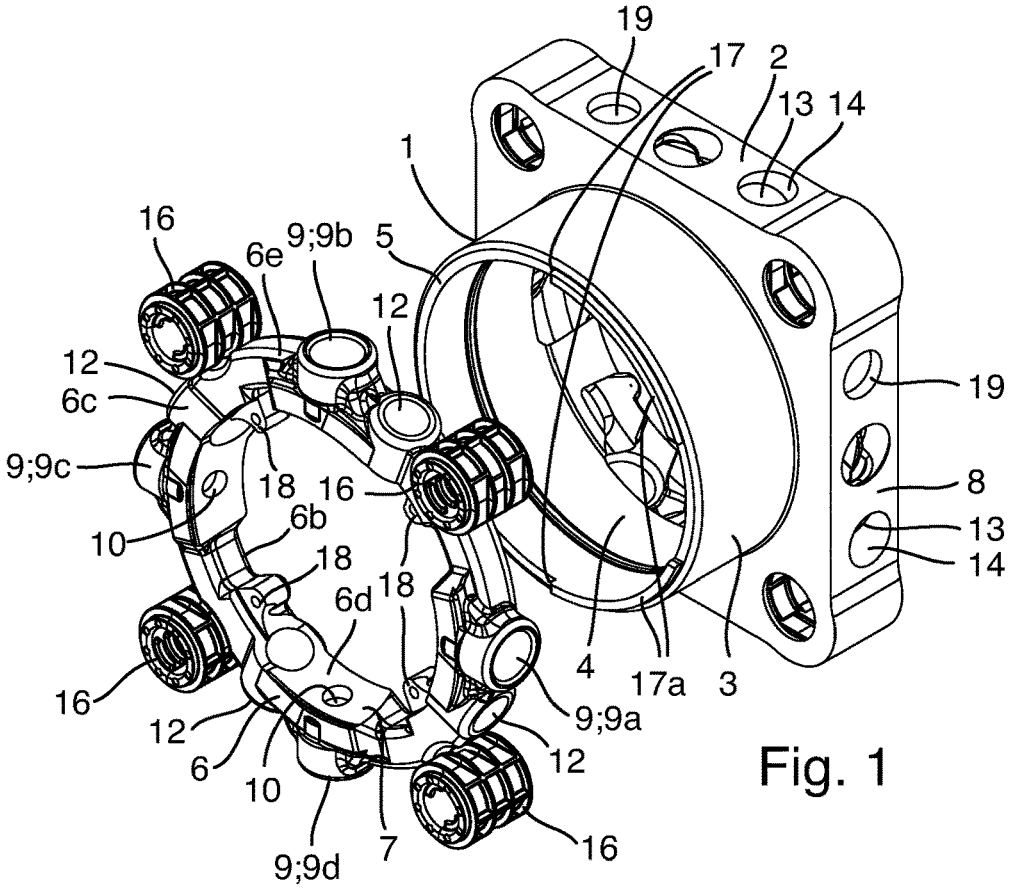
FIG. 1 shows a perspective exploded view of an exemplary embodiment of a wall installation connection box unit configured as a sanitary wall installation connection box unit.
Figure 2:
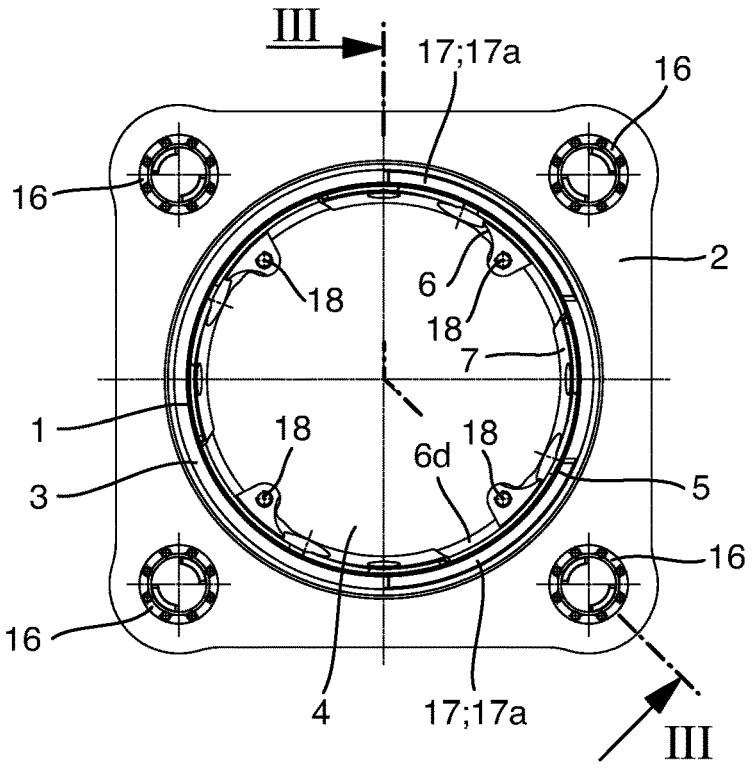
FIG. 2 shows a front side view of the connection box unit from FIG. 1.

The embodiments of the invention described herein are not intended to be exhaustive or to limit the invention to precise forms disclosed. Rather, the embodiments selected for description have been chosen to enable one skilled in the art to practice the invention.

The sanitary wall installation connection box unit illustrated in the figures with reference to an exemplary embodiment includes a box housing body 1 having a rear-side base portion 2 and a sleeve portion 3 projecting forward from the base portion 2, and a connector body 6 disposed on the base portion 2 of the box housing body 1. The sleeve portion 3 peripherally surrounds an installation component mounting space 4, in this case a sanitary component mounting space, which space is accessible via an open front end face 5 of the sleeve portion 3. The connector body 6 includes an installation component connection contour 7, in this case a sanitary component connection contour, facing the installation component mounting space 4, a conduit connection interface structure 9, here a fluid conduit connection interface structure, accessible on an outer side 8 of the box housing body 1, and a fluid channel structure 10. The fluid channel structure 10 ensures the required fluid connection of the fluid conduit connection interface structure 9 to the sanitary component connection contour 7.

The base portion 2 and the sleeve portion 3 of the illustrative box housing body 1 are integrally formed from a synthetic foamed material. The connector body 6 is composed of a metal or plastics material that is stiffer and firmer by comparison and is embedded in the synthetic foamed material of the base portion 2, wherein the fluid conduit connection interface structure 9 and the sanitary component connection contour 7 are exposed, i.e. are not covered by the synthetic foamed material of the box housing body 1. The synthetic foamed material therefore does not obstruct either the coupling of the connection box unit to a pipe conduit connection structure in the building via the fluid conduit connection interface structure 9 or the coupling of a sanitary component, which is introduced into the sanitary component mounting space 4 of the box housing body 1, to the connector body 6 via the connection contour 7 thereof. In the exploded view of FIG. 1, the connector body 6 is shown removed from its embedding in the box housing body 1 such that its contour can be seen more clearly.

In corresponding illustrative embodiments, the connector body 6, as in the example shown, has an annular shape and is surrounded by adjacent synthetic foamed material of the base portion 2 of the box housing body 1 on a peripheral outer side. In other words, a peripheral outer side **6*a* of the connector body 6 is adjoined radially on the outside with touching contact by an inner side 2*a* of the base portion 2 of the box housing body 1, as can be seen in particular from FIGS. 3 and 4. This ensures reliable sealing between the connector body 6 and the box housing body 1 in this region. In the example shown, the connector body 6** has a closed annular shape; in alternative embodiments, it has an open annular shape or a shape differing from a ring, in particular also a shape as is known per se from conventional connector bodies used in wall installation connection box units.

In advantageous embodiments, the base portion 2 of the box housing body 1, as in the exemplary embodiment shown, has a closed rearward bottom 11, and the connector body 6 on a rear side adjoins the synthetic foamed material of the bottom 11. In other words, a rear side 6*b* of the connector body 6 adjoins, with touching contact, a front side 11*a* of the rearward bottom 11, as can be seen in particular from FIG. 3. The closed design of the rearward bottom 11 provides a fluid-tight rear side closure of the box housing body 1, and the direct bearing of the rear side 6*b* of the connector body 6 and the front side 11*a* of the bottom 11 against each other ensures the fluid tightness between the connector body 6 and the box housing body 1 in this region.

In corresponding embodiments, the connector body 6, as in the exemplary embodiment shown, on a front side on a boundary region 6*c* adjoins the synthetic foamed material of the base portion 2 of the box housing body 1. In other words, the synthetic foamed material of the box housing body 1 in a corresponding boundary region 2*b* of the base portion 2 bears with touching contact against said front-side boundary region 6*c* of the connector body 6. This ensures reliable sealing between the connector body 6 and the box housing body 1 in this region.

In advantageous embodiments, if the connector body 6 has a closed annular shape, the sanitary component connection contour 7 is provided on an inner peripheral side 6*d* of the connector body 6, and the fluid conduit connection interface structure 9 is formed on an outer peripheral side 6*e* of the connector body 6, as in the exemplary embodiment shown.

Depending on requirements, the fluid conduit connection interface structure 9 has one, two or more connection interfaces. In the example shown, the fluid conduit connection interface structure 9 includes a plurality of connection interfaces, by way of example in the form of four connectors 9*a*, 9*b*, 9*c*, 9*d* offset by 90° in each case at a peripheral angular interval, wherein all of the connection interfaces are formed on the peripheral outer side 6*e* of the connector body 6. In alternative embodiments, one, more than one or all of the connection interfaces of the fluid conduit connection interface structure 9 are formed facing rearwards on the rear side 6*b* of the connector body 6.

Figure 4:
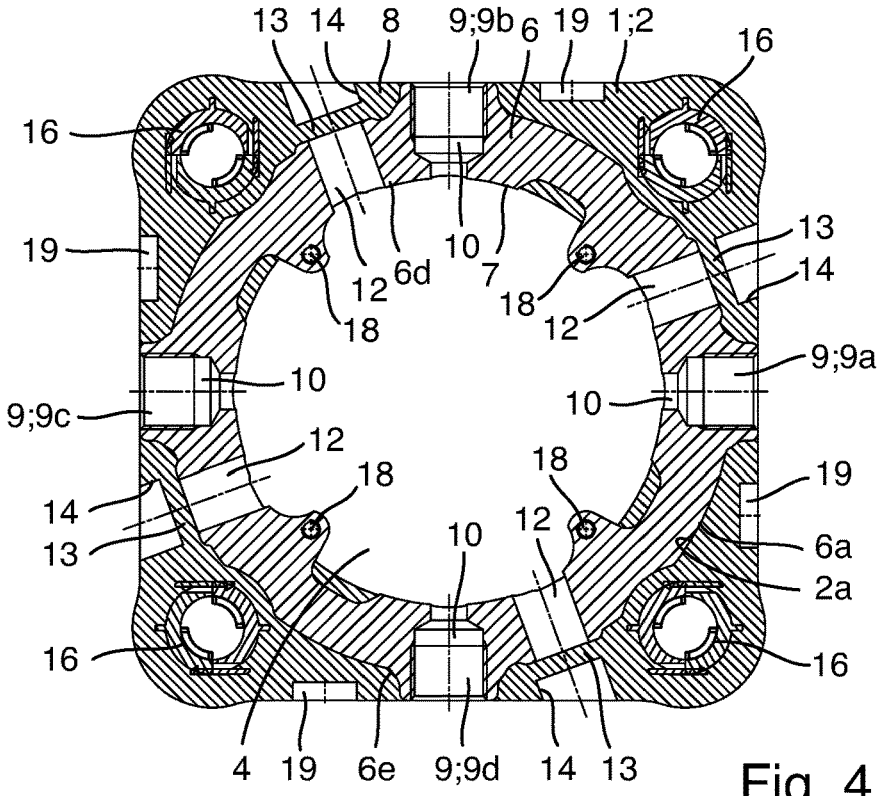
FIG. 4 shows a sectional view along a line IV-IV in FIG. 3.

In corresponding embodiments, the connector body 6, as in the example shown, has at least one passage opening 12 extending from its outer side to its inner side, which opening is covered on an outer side by a sealing membrane portion 13 of the synthetic foamed material of the base portion 2, as is apparent in particular from FIG. 4. In the example shown, there are four passage openings 12 which each extend from the peripheral outer side 6*e* of the connector body 6 to the peripheral inner side 6*d* thereof. The passage opening can be used, for example, for the passage of an electrical cable or of another elongate element, for which purpose the sealing membrane portion 13 is then suitably opened. If the passage opening 12 in the connector body 6 is not required for this purpose, it remains unoccupied and covered by the sealing membrane portion 13 of the synthetic foamed material of the box housing body 1. In alternative embodiments, the connector body 6 does not have such a passage opening 12.

In corresponding realizations, the synthetic foamed material of the base portion 2 of the box housing body 1, as in the exemplary embodiment shown, includes a tube insertion port opening 14 which adjoins the sealing membrane portion 13 at an outer side, as can likewise be seen in particular from FIG. 4. The tube insertion port opening 14 can be used in particular to insert, and thereby hold, a hollow tube or empty tube by its tube end region therein, wherein the hollow or empty tube, for its part, can be used to receive an elongate element, for example an electrical cable, which can then, by opening the sealing membrane portion 13, be guided further through the passage opening 12 into the sanitary component mounting space 4 or into the interior of the box housing body 1.

Figure 3:
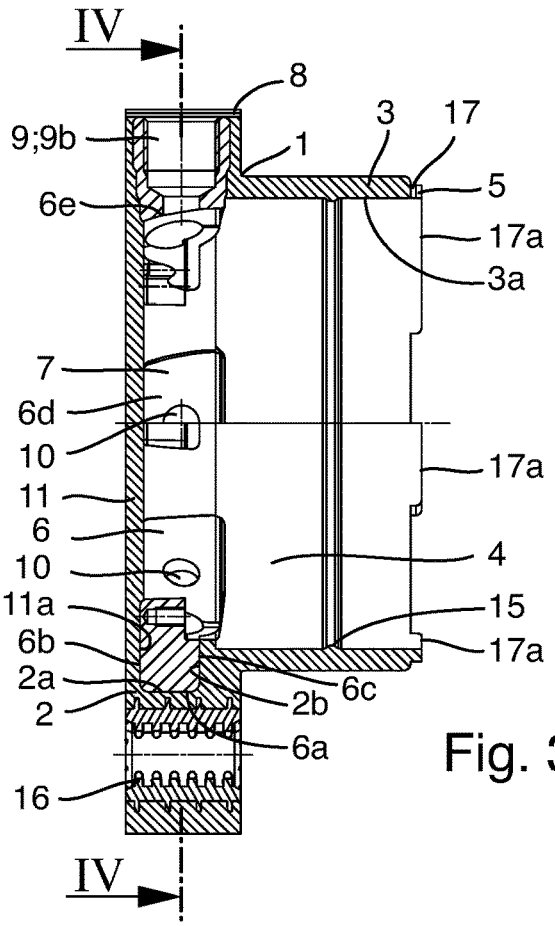
FIG. 3 shows a sectional view along a line in FIG. 2.

In corresponding realizations, the sleeve portion 3 of the box housing body 1, as in the exemplary embodiment shown, has a radially inwards projecting ridge protrusion 15 on an inner peripheral side, i.e. on an inner side 3*a* of the sleeve portion 3, as is apparent in particular from FIG. 3. The ridge protrusion 15 can be used, for example, in a manner which is not shown, to guide and to hold an extension sleeve in a sealing manner in the sleeve portion 3 such that it can be adjusted in height continuously axially, in order, with the extension sleeve, to variably extend the axial extent of the box housing body 1 in the forwards direction beyond the free end face 5 of the sleeve portion 3, i.e. to the right in FIG. 3. In an alternative embodiment, the sleeve portion 3 does not have such a ridge protrusion 15.

In an advantageous realization, the box housing body 1 is formed integrally from a thermoplastic particle foamed material which acts in this case as the synthetic foamed material. This choice of material proves very favorable in terms of production and functionally for the intended use of providing the box housing body 1 for the sanitary wall installation connection box unit. Alternatively, the box housing body 1 is formed from a different synthetic foamed material.

In advantageous embodiments, at least one connection structure element 16 is embedded into the synthetic foamed material of the base portion 2 of the box housing body 1, as in the exemplary embodiment shown. The connection structure element 16 has a connection structure which, when required, can interact with a connection body (not shown) with which a functional surface body (not shown) can be held on the base portion 2, said functional surface body providing a functional surface radially outside the sleeve portion 2. This functional surface can be used in particular as a fastening and/or sealing surface in order to fasten the box housing body 1 to a wall surface of the building and/or to seal same in relation to a wall surface of the building.

In the exemplary embodiment shown, specifically four such connection structure elements 16 are embedded into the synthetic foamed material of the base portion 2, for example, as shown offset in each case by 90° in relation to one another in the peripheral angular direction in corner regions of the square base portion 2. In alternative embodiments, only one, two, three or more than four such connection structure elements 16 are embedded into the synthetic foamed material of the base portion 2, and/or one or more such connection structure elements 16 are arranged in a different distribution or in other regions of the base portion 2, or the connection box unit is formed without such connection structure elements.

In the exemplary embodiment shown, the base portion 2 has by way of example a square or quadratic, cuboidal form; in other embodiments, it is formed by a different shape, for example triangular or polygonal with more than four corner regions, or with a circular or oval cross section. In the example shown, the sleeve portion 2 is circular-cylindrical; in alternative embodiments, it can also be of a different shape, for example can have a polygonal or oval cross-sectional shape. In the example shown, the connection body 6 has radially inwards projecting holding extensions 18 with fastening openings, which are part of a connection means (otherwise not shown) for securing an installation component, which is introduced into the mounting space, to the connection body 6. In alternative embodiments, other conventional connection means are provided for this purpose.

In corresponding embodiments, the box housing body 1, as in the example shown, has, on the front end face 5 of its sleeve portion 3, an aligning aid 17 which makes it easier for the installer to align the box housing body 1 during installation on a wall. The aligning aid 17 includes two axially projecting aligning webs 17*a* which each extend spaced apart from one another at a predetermined peripheral angular interval over a predetermined peripheral angular region and against the peripheral web ends of which an aligning means, for example in the form of a spirit level, level or circular level, can be placed in a manner known per se. This makes it easier for the installer to align the box housing body 1 vertically and/or horizontally before the final wall installation steps. Alternatively or, as in the example shown, additionally, the box housing body 1 includes an equivalent aligning aid in the form of one or, as shown, a plurality of level receiving openings 19 which are each in the form of a blind hole in the synthetic foamed material of the base portion 2 on the outer periphery thereof, optionally, as shown, on different or on all the peripheral sides, and into which a conventional circular level or the like can be inserted.

As the exemplary embodiments which are shown and the other exemplary embodiments explained above make clear, the invention provides a wall installation connection box unit which provides advantages functionally and in terms of manufacturing, in particular on the basis of the integral formation of the base portion and the sleeve portion of the box housing body from a synthetic foamed material and on the embedding of the connector body into the synthetic foamed material of the base portion, and which can be correspondingly advantageously used in particular as a sanitary wall installation connection box unit in sanitary installation technology and as an electrical wall installation connection box unit in electrical installation technology.

Although the invention has been described in detailed with reference to preferred embodiments, variations and modifications exist within the spirit and scope of the invention as described and defined in the following claims.

The invention claimed is:

1. A wall installation connection box unit, comprising:

a box housing body having a rear-side base portion and a sleeve portion projecting forward from the base portion, which sleeve portion peripherally surrounds an installation component mounting space, which installation component mounting space is accessible via an open front end face of the sleeve portion; and a connector body disposed on the base portion of the box housing body, which connector body comprises an installation component connection contour facing the installation component mounting space, and a conduit connection interface structure accessible on an outer side of the box housing body;

wherein:

a single integrally formed piece of synthetic foamed material forms both the sleeve portion and the base portion of the box housing body, and the connector body is embedded in the synthetic foamed material of the base portion, wherein the conduit connection interface structure and the installation component connection contour are exposed.

2. The wall installation connection box unit according to claim 1, wherein the connector body has an annular shape and is surrounded by adjacent synthetic foamed material of the base portion on a peripheral outer side.

3. The wall installation connection box unit according to claim 1, wherein the base portion has a closed rearward bottom, and the connector body on a rear side adjoins the synthetic foamed material of the bottom.

4. The wall installation connection box unit according to claim 1, wherein the connector body on a front side on a boundary region adjoins the synthetic foamed material of the base portion.

5. The wall installation connection box unit according to claim 1, wherein the connector body has a closed annular shape, the installation component connection contour is provided on an inner peripheral side of the connector body, and the conduit connection interface structure is formed on an outer peripheral side of the connector body.

6. The wall installation connection box unit according to claim 1, wherein the connector body has at least one passage opening extending from an outer side to an inner side, which opening is covered on the outer side by a sealing membrane portion of the synthetic foamed material of the base portion.

7. The wall installation connection box unit according to claim 6, wherein the synthetic foamed material of the base portion comprises a tube insertion port opening which adjoins the sealing membrane portion at an outer side.

8. The wall installation connection box unit according to claim 1, wherein the sleeve portion has a radially inwards projecting ridge protrusion on an inner peripheral side.

9. The wall installation connection box unit according to claim 1, wherein at least one connection structure element is embedded into the synthetic foamed material of the base portion.

10. The wall installation connection box unit according to claim 1, wherein the synthetic foamed material is a thermoplastic particle foamed material.

11. The wall installation connection box unit according to claim 1, wherein the wall installation connection box unit is a sanitary wall installation connection box unit.

* * * * *